US005175324A

United States Patent [19]

Kulprathipanja

[11] Patent Number: 5,175,324

[45] Date of Patent: Dec. 29, 1992

[54] PROCESS FOR SEPARATING TRIGLYCERIDES HAVING DIFFERENT DEGREES OF UNSATURATION

[75] Inventor: Santi Kulprathipanja, Inverness, Ill.

[73] Assignee: UOP, Des Plaines, Ill.

[21] Appl. No.: 687,644

[22] Filed: Apr. 19, 1991

[51] Int. Cl.[5] ..... C11B 7/00

[52] U.S. Cl. ..... 554/193

[58] Field of Search ..... 260/428.5; 554/193

[56] References Cited

U.S. PATENT DOCUMENTS 4,284,580 8/1981 Logan et al. ..... 260/428.5

4,770,819 9/1988 Zinnen ..... 260/428.5

*Primary Examiner*—Jose G. Dees

*Assistant Examiner*—Deborah D. Carr

*Attorney, Agent, or Firm*—Thomas K. McBride; John F. Spears, Jr.; Jack H. Hall

[57] ABSTRACT

The separation of monounsaturated triglycerides from polyunsaturated triglycerides is achieved by an adsorptive chromatographic process in liquid phase with silica gel as the adsorbent at temperatures higher than about 100° C. Desorbents in the separation process include ketones, having from 3 to 8 carbon atoms in concentrations of up to about 25% (vol.) in normal or branched alkanes, e.g., n-hexane or iso-octane, or p-cymene in concentrations of 20% (vol.) to 100%.

8 Claims, No Drawings

PROCESS FOR SEPARATING TRIGLYCERIDES HAVING DIFFERENT DEGREES OF UNSATURATION

FIELD OF THE INVENTION

The field of art to which this invention belongs is the solid bed adsorptive separation of triglycerides. More specifically, the invention relates to a process for separating triglyceride mixtures having at least two triglycerides with different degrees of unsaturation by a process which employs silica gel.

BACKGROUND OF THE INVENTION

An economical and efficient method for separating triglycerides on the basis of degree of unsaturation has previously been sought to satisfy commercial pressures. For example, in Ou U.S. Pat. No. 4,961,881, the desirability of reducing the level of unsaturated fatty acid groups in synthetically produced triglycerides was disclosed since the product could be used as a cocoa butter extender. In view of more recent trends to reduce the monounsaturated components of triglyceride mixtures for health reasons, the applications of such a process in edible products, such as margarine, mayonnaise, etc., are apparent.

Thus, the value of available feed materials such as soybean oil, cottonseed oil, linseed oil, corn oil, peanut oil, sunflower oil, safflower oil, canola oil, olive oil, rich bran oil, sesame, and almond, etc., can be enhanced by processing to give fractions which are enriched or deleted in unsaturation. Other highly saturated feeds, such as tallow, lard. coconut, palm oil, butter fat, etc., may be reacted with unsaturated fatty acids via an interesterification process, as disclosed in U.S. Pat. Nos. 4,275,081 or 3,328,439, to increase the degree of unsaturation and the product thereof can be separated by the process of the invention.

The separation of many classes of compounds by selective adsorption on molecular sieves or zeolites as well as other adsorbents is well known. Also, various separations based on the degree of unsaturation are known, e.g., esters of saturated fatty acids from unsaturated fatty acids with X or Y zeolites exchanged with a selected cation, from U.S. Pat. No. 4,048,205, monoethanoid fatty acids from diethanoid fatty acids with cross-linked polystyrenes, e.g., "Amberlite", from U.S. Pat. No. 4,353,838. A process for separating a mixture of triglycerides, based on the iodine values, is shown in U.S. Pat. Nos. 4,277,412 and 4,284,580 in which permutite and surface-aluminated silica gel adsorbents, respectively, can be used. However, both of these require silver-exchanged surface-aluminated silica gel adsorbents, which is not only undesirable in food product preparation, but rapid fouling of these adsorbents by any impurities in the feed mixtures has limited commercial application of these materials. Ou U.S. Pat. No. 4,961,881 describes a process for overcoming the deactivation of the surface-treated silica gel of U.S. Pat. No. 4,284,580 by continuously or intermittently regenerating the adsorbent with hydrogen peroxide or an organic peroxide. The adsorbents of the present invention are stable and thus do not exhibit the rapid deactivation that is exhibited by the prior art absorbents.

The adsorption properties of silica gels have been reported and found useful in certain analytical separations, e.g., thin layer chromatography (TLC). For example, Plattner et al, Lipids 14 (2), (1979), pp 152-3 reported that triglycerols could be separated by both chain length and number of double bonds with reverse phase columns, i.e., μ-Bondapak $C_{18}$ or μ-Porasil silica gels with octadecyl silyl groups bonded to silica particles. Also, Plattner et al, JAOCS 54 (11) (November 1977) pp 511-15. Acetonitrile: acetone (2:1 v/v) mixtures were used as elution agents. Neither, however, describes a process capable of separating triglycerides by degree of unsaturation in bulk quantities nor the preferred desorbents of the present invention.

Japanese Public Disclosure No. 192797/86 discloses a method for concentrating eicosapentaenoic acid and docosahexaenoic acid in their triglyceride forms with silica gel chemically bound with an octadecyl group or a styrene-divinylbenzene copolymer.

Zinnen U.S. Pat. No. 4,784,807 discloses the separation of triglycerides based on degree of unsaturation with omega zeolite or carbon adsorbents and ketones, toluene and ketone/aliphatic hydrocarbon mixtures as desorbents.

The invention herein can be practiced in fixed or moving adsorbent bed systems, but the preferred system for this separation is a countercurrent simulated moving bed system, such as described in Broughton U.S. Pat. No. 2,985,589, incorporated herein by reference. Cyclic advancement of the input and output streams can be accomplished by a manifolding system, which are also known, e.g., by rotary disc valves showing in U.S. Pat. Nos. 3,040,777 and 3,422,848. Equipment utilizing these principles are familiar, in sizes ranging from pilot plant scale (deRosset U.S. Pat. No. 3,706,812) to commercial scale in flow rates from a few cc per hour to many thousands of gallons per hour.

The functions and properties of adsorbents and desorbents in the chromatographic separation of liquid components are well known, but for reference thereto, Zinnen et al U.S. Pat. No. 4,770,819, which relates to the separation of diglycerides from triglycerides with omega zeolite or silica adsorbents, is incorporated herein. From FIG. 1 and Example II of this patent, it can be seen that Zinnen et al was not able to separate triglycerides on the basis of degree of unsaturation with silica gel, since all the triglycerides eluted at the same time.

I have found that monounsaturated triglycerides can be separated from mixtures with polyunsaturated triglycerides with silica gel which will selectively adsorb the more highly unsaturated triglycerides contained in triglyceride mixtures relative to monounsaturated triglyceride components, provided that the temperature at which the separation is conducted is at least about 100° C. and the desorbent liquid contains a lower ketone ($C_3$-$C_8$) in concentrations of from 5% (vol.) up to about 25% (vol.), preferably from about 10-20% (vol.) or p-cymene in concentrations of 20-100% (vol.).

Silica gel is thermally stable and thus can be regenerated easily at elevated temperatures without collapsing the pore structure, Furthermore, since there are no metal exchange ions, silica gel is deemed suitable for the separation of food products and is chemically stable to impurities contained in the feed.

SUMMARY OF THE INVENTION

The present invention is a process for separating feed mixtures of unsaturated triglycerides having different degrees of saturation into fractions containing monounsaturated triglycerides and polyunsaturated triglycerides from mixtures of monounsaturated and polyunsaturated triglycerides. The process comprises contacting the mixture at adsorption conditions and a temperature of at least 100° C., preferably from 120° C. to 150° C., with an adsorbent comprising silica gel whereby the polyunsaturated triglycerides are more selectively adsorbed than the monounsaturated triglycerides. The polyunsaturated triglycerides are desorbed by a liquid ketone having from 3 to 8 carbon atoms in a concentration of up to about 25% in a normal alkane or p-cymene in concentrations from about 20% (vol.) to about 100%. Monounsaturated triglycerides are relatively unadsorbed by the molecular sieve and are removed before the polyunsaturated triglycerides and, together with desorbent, constitute the raffinate. The ketones have up to 8 carbons, e.g., acetone, methyl ethyl ketone, the pentanones, hexanones, heptanones and octanones. Specific examples of ketones useful in the process are acetone, methyl ethyl ketone, diethyl ketone, methyl propyl ketone, 2-hexanone, 2-heptanone, 3-heptanone, 2-octanone, etc., and mixtures thereof with hydrocarbons.

In a specific embodiment, a feed composition analyzing from 40 to 92% polyunsaturated triglycerides can be separated by the process of the invention to produce a product stream with an increase of at least about 4 percentage points, to, e.g., up to about 96% polyunsaturated triglycerides or higher.

Other embodiments of my invention encompass details about feed mixtures, adsorbents, desorbent materials and operating conditions, all of which are hereinafter disclosed in the following discussion of each of the facets of the present invention.

DETAILED DESCRIPTION OF THE INVENTION

Highly unsaturated triglycerides are desirable fats and oils for use in certain foods, such as mayonnaise, salad dressings, etc. Many natural or synthetic products contain high percentages of polyunsaturated triglycerides along with substantial amounts of monounsaturated and saturated triglycerides. It would be commercially desirable to remove some (or all) of the saturated and monosaturated triglycerides while increasing the concentration of polyunsaturated triglycerides to at least about 96% by means of a direct separation. It has previously been proposed to separate triglycerides as a class from free fatty acids, but in order to obtain highly unsaturated triglycerides it was necessary to first subject the natural triglyceride feeds to an interesterification reaction step to interchange unsaturated free fatty acids with saturated fatty acid groups of the triglyceride molecule. Such an extra step is costly and can be avoided by the separation process of the present invention.

Feed materials which may be used in the separation include naturally occurring oils, such as linseed oil, cottonseed oil, corn oil, peanut oil, palm oil, sunflower oil, canola oil, safflower oil, etc. The preferred feed material will have a polyunsaturated triglyceride content of 75 to 92%, which can be upgraded by the process of the invention to 96% or higher polyunsaturated triglycerides.

The absorbent used in the invention is a silica gel which is amorphous silica having a pore diameter greater than about 7 Å and preferably in the range of 22 to 150 Å. I prefer to use unsupported silica gel having the following characteristics:

Particle size: 35 to 60 Mesh (U.S.)

Pore size: 20 to 150 Å

Pore volume: 0.45 to 1.2 cc/g

Surface area (BET): 300 to 800 $m^2/g$.

Silica gels illustrative of the range of values set forth above include: Davisil 646 silica gel, Davisil 636 silica gel and Bead Gel, all available from Davison Division of W. R. Grace & Co. and Merck 10181 silica gel. The values are set forth in the following table. Particle size of all the listed materials is in the range of 35–60 Mesh (U.S.).

TABLE 1

| Silica Gel | Pore Size (Å) | Surface Area Pore Vol. cc/g | (BET) $m^2/g$ |
|---|---|---|---|
| Davisil 646 | 150 | 1.15 | 300 |
| Davisil 636 | 60 | 0.75 | 480 |
| Merck 10181 | 40 | 0.68 | 675 |
| Bead Gel | 22 | 0.45 | 800 |

Davisil 636 is preferred in the separation because of its greater capacity. The adsorbents used in the invention are inert and have no exchangeable ions.

The water content of the adsorbent affects the separation capacity and exchange rates and may also affect its stability. Acceptable levels of water in the adsorbent in terms of loss on ignition (LOI) are from 0 to 10% (wt.), preferably from 0–3% (wt.). To reduce water content to the desired level, the adsorbent may also be dried in air, nitrogen, or other gas at elevated temperature. The adsorbent may also be dried by application of vacuum, maintaining the temperature initially at room temperature until most of the water is removed, then raising the temperature to 50° C. while maintaining vacuum.

The general scheme for the adsorption separation such as practiced here is known from, e.g., Broughton, U.S. Pat. No. 3,985,589. Briefly, the less adsorbed feed component(s) is eluted from the non-selective void volume and weakly adsorbing volume before the more strongly adsorbed component(s). The relatively unadsorbed component(s) is thereby recovered in the raffinate stream, while the more strongly adsorbed component(s) is recovered in the extract stream.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor phase operation. Adsorption conditions will include a temperature range of from about 100° C. to about 200° C., preferably from about 120° C. to about 150° C., and a pressure sufficient to maintain liquid-phase, ranging from about atmospheric to about 400 psig, with from about atmospheric to about 200 psig usually being adequate. Desorption conditions will include the same range of temperatures and pressures as used for adsorption conditions.

Zinnen U.S. Pat. No. 4,770,819, supra, indicated that triglycerides of different levels of unsaturation could not be separated chromatographically with silica gel. However, I have discovered that, surprisingly, by the use of elevated temperatures and certain desorbents at low concentrations, the separation of monounsaturated triglycerides from polyunsaturated triglycerides can be achieved. Thus, it is essential to the invention that the separation process is conducted at a temperature of at least about 100° C. and, preferably from about 120° C. to 150° C. The discovery that this separation could be achieved at elevated temperatures was unexpected, but can perhaps be explained on the basis that, at the lower temperatures taught by the prior art, e.g., about 60° C., the mass transfer rate of PUT's into the selectively adsorbing volume of the silica gel is so slow that at least a substantial portion of, and perhaps virtually all, the PUT's are eluted with the MUT's at the void volume. Thus, the prior art gave no suggestion that a separation could be achieved by increasing the temperature of the separation to above about 100° C., preferably 120° C. to 150° C.

The desorbent material for the preferred isothermal, isobaric, liquid-phase operation of the process of my invention comprises up to about 25% (vol.), and preferably from about 10–20% (vol.), of a low molecular weight ketone having from 3–8 carbon atoms diluted with a liquid hydrocarbon. The ketones include acetone, methyl ethyl ketone, diethyl ketone, methyl butyl ketone, 2-heptanone, 3-heptanone, dipropyl ketone, 2-octanone, 3-octanone, etc. The ketones are mixed with hydrocarbon liquids, e.g., normal or branched paraffinic liquids, to modify the strength of the desorbent. Preferred combinations are n-heptanone or acetone in concentrations of 5–25% (vol.) in a normal alkane, especially n-hexane, and more preferably from about 10% to about 20% (vol.). Other diluents include branched alkanes, e.g., iso-octane, etc.

Another class of desorbent is alkyl-substituted aromatic hydrocarbons, especially p-cymene. P-cymene may be used undiluted (100%) or diluted up to about 80% (wt.) with a hydrocarbon (normal or branched). Preferred diluents include n-hexane and iso-octane.

At least a portion of the raffinate stream, which contains the concentrated MUT's product, and preferably at least a portion of the extract stream (PUT's) from the separation process are passed to separation means, typically fractionators or evaporators, where at least a portion of desorbent material is separated to produce a raffinate product and an extract product, respectively.

A dynamic testing apparatus is employed to test various adsorbents with a particular feed mixture and desorbent material to measure the adsorption characteristics of retention, capacity and exchange rate. The apparatus consists of a helical adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect qualitatively, or determine quantitatively, one or more components in the effluent stream leaving the adsorbent chamber. A pulse test, performed using this apparatus and the following general procedure, is used to determine data, e.g., selectivity, for various adsorbent-/desorbent systems. The adsorbent is placed in a chamber and filled to equilibrium with a particular desorbent material by passing the desorbent material through the adsorbent chamber. At a convenient time, a pulse of feed containing known concentrations of a tracer or of a raffinate component, or both, and of a particular extract component, all diluted in desorbent material is injected for a duration of several minutes. Desorbent material flow is resumed, and the tracer or the raffinate component (or both) and the extract component are eluted as in a liquid-solid chromatographic operation. The effluent can be analyzed on-stream, or, alternatively, effluent samples can be collected periodically and later analyzed separately by analytical equipment and traces of the envelopes or corresponding component peaks developed.

From information derived from the test, adsorbent performance can be rated in terms of void volume, retention volume for an extract or a raffinate component, the rate of desorption of an extract component from the adsorbent and selectivity. The retention volume of an extract or a raffinate component may be characterized by the distance between the center of the peak envelope of the extract or raffinate component and the center of the peak envelope of the tracer component (void volume) or some other known reference point. It is expressed in terms of the volume in cubic centimeters of desorbent material pumped during this time interval represented by the distance between the peak envelopes. The rate of exchange or desorption rate of an extract component with the desorbent material can generally be characterized by the width of the peak envelopes at half intensity. The narrower the peak width, the faster the desorption rate. Selectivity, $\beta$, is determined by the ratio of the net retention volumes of the more strongly adsorbed component to each of the other components.

The examples shown below are intended to further illustrate the process of this invention without unduly limiting the scope and spirit of said process. In the examples, the fatty acid residues are sometimes abbreviated as follows: P=palmitoyl, S=stearyl, O=oleyl and L=linoleyl. Also, a void volume of 41.0 ml., previously determined experimentally for similar desorbents, was assumed and used as the reference point for calculating net retention volume.

EXAMPLE I

A pulse test as described above was performed to evaluate the process of the present invention for separating monounsaturated triglycerides from polyunsaturated triglycerides. The column was filled with 70 cc of silica gel adsorbent (Davisil 636 available from Davison Division of W. R. Grace and Co.) dried to 200° C. under $N_2$. The column was maintained at a temperature of 150° C. and a pressure sufficient to provide liquid-phase operations. The feed was 5 cc of a mixture of 0.2 g cocoa butter (monounsaturated triglycerides) in the following approximate proportions: 30% (wt.) POP; 30% (wt.) POS; 40% (wt.) SOS; 0.25 g safflower oil (polyunsaturated triglycerides) in the following approximate proportions: 60% (wt.) LLL; 20% (wt.) LLO; 20% (wt.) LOO and 2.05 g n-hexane.

The desorbent was a 10/90 mixture (by vol.) of acetone and n-hexane. The desorbent material was run continuously at a nominal liquid hourly space velocity (LHSV) of 1 (1.26 ml per minute flow rate). At some convenient time interval, the desorbent was stopped and the feed mixture was run for a 4 minute interval at a rate of 1.26 ml/min. The desorbent stream was then resumed at 1 LHSV and continued to pass into the adsorbent column until all of the feed components had been eluted from the column as determined by analyzing the effluent stream leaving the adsorbent column. The monounsaturated triglycerides, POP, POS and SOS were least strongly adsorbed and eluted first, followed by the polyunsaturated triglyceride components, LLL, LLO and LOO, which were the most strongly adsorbed components. The results are set forth in the following Table 2 of gross retention volumes (GRV), net retention volumes (NRV) by experiment 41 ml is void vol. of adsorbent, selectivities ($\beta$) and width at one-half peak height (HW)

TABLE 2

| Component | GRV | NRV | Selectivity ($\beta$) | HW |
|---|---|---|---|---|
| Void Volume | 41.0 | 0 | ∞ | — |
| MUT's (POP, POS, SOS) | 61.3 | 20.3 | 1.4 | 10.4 |
| POP | 63.2 | 22.3 | 1.3 | 8.4 |
| POS | 61.5 | 20.5 | 1.4 | 9.9 |
| SOS | 59.8 | 18.8 | 1.5 | 9.7 |
| PUT's (LLL, LLO, LOO) | 69.3 | 28.3 | 1.00 | 9.2 |

A second pulse test was run identically to the above except that the temperature was 60° C. At this temperature, large quantities of PUT's broke through near the void volume, with the MUT's, significantly reducing the recovery of PUT's in the extract fraction and also raising the level of PUT's (impurity) in the MUT raffinate fraction.

EXAMPLE II

The pulse test of Example I was repeated, except that the desorbent was a 15/85 mixture of 2-heptanone/n-hexane. The temperature in the column was 150° C. and flow rate was 1.22 ml/min. As seen in the following Table 3 of results, the MUT's are eluted first, followed by the PUT's. The individual MUT's were analyzed and listed in the table.

TABLE 3

| Component | GRV | NRV | Selectivity ($\beta$) | HW |
|---|---|---|---|---|
| Void Volume | 41.0 | 0 | ∞ | — |
| MUT's (POP, POS, SOS) | 58.3 | 17.3 | 1.4 | 9.2 |
| POP | 60.1 | 19.1 | 1.3 | 7.8 |
| POS | 58.3 | 17.3 | 1.4 | 8.8 |
| SOS | 57.0 | 16.0 | 1.5 | 9.3 |
| PUT's (LLL, LLO, LOO) | 64.9 | 23.9 | 1.00 | 7.3 |

A second pulse test was conducted under the same conditions except that a 20/80 mixture of 2-heptanone/n-hexane was used as the desorbent. The results are shown in the following Table 4.

TABLE 4

| Component | GRV | NRV | Selectivity ($\beta$) | HW |
|---|---|---|---|---|
| Void Volume | 41.0 | 0 | ∞ | — |
| MUT's (POP, POS, SOS) | 52.3 | 11.3 | 1.5 | 8.6 |
| POP | 53.7 | 12.7 | 1.3 | 8.1 |
| POS | 52.4 | 11.4 | 1.5 | 8.5 |
| SOS | 51.2 | 10.2 | 1.6 | 8.3 |
| PUT's (LLL, LLO, LOO) | 57.7 | 16.7 | 1.00 | 6.7 |

A third pulse test, conducted under the same conditions as the first except that the temperature was 60° C., showed that the silica gel exhibited virtually no selectivity between MUT's and PUT's.

EXAMPLE III

A further pulse test was run using the same feed and adsorbent as Example I in which the conditions were as follows: temperature of 150° C.; flow rate of 1.27 ml/min; desorbent was 100% p-cymene. The results are shown in the following Table 5.

TABLE 5

| Component | GRV | NRV | Selectivity ($\beta$) | HW |
|---|---|---|---|---|
| Void Volume | 41.0 | 0 | ∞ | — |
| MUT's (POP, POS, SOS) | 77.0 | 26 | 2.4 | 14.2 |
| POP | 80.5 | 39.5 | 1.6 | 17.4 |
| POS | 77.1 | 26.1 | 2.4 | 13.8 |
| SOS | 74.5 | 23.5 | 2.7 | 10.2 |
| PUT's (LLL, LLO, LOO) | 104.3 | 63.3 | 1.00 | 47.5 |

What is claimed is:

1. In a process for separating monounsaturated triglycerides from polyunsaturated triglycerides comprising contacting a mixture of mono- and polyunsaturated triglycerides with silica gel adsorbent to selectively adsorb said polyunsaturated triglycerides, removing said monounsaturated triglycerides from said adsorbent and desorbing said polyunsaturated triglycerides from said adsorbent with a desorbent comprising a ketone having from 3–8 carbon atoms, the improvement comprising conducting said separation at a temperature of at least about 100° C. and with said ketone at a concentration of up to about 25% (vol.).

2. The process of claim 1 wherein the balance of said desorbent is a normal hydrocarbon (alkane).

3. The process of claim 1 wherein said temperature is from about 120° C. to about 150° C.

4. The process of claim 1 wherein said desorbent comprises from about 5–15% (vol.) of said ketone.

5. The process of claim 1 wherein said ketone is 2-heptanone.

6. The process of claim 4 wherein said ketone is 2-heptanone.

7. In a process for separating monounsaturated triglycerides from polyunsaturated triglycerides comprising contacting a mixture of mono- and polyunsaturated triglycerides with silica gel adsorbent to selectively adsorb said polyunsaturated triglycerides, removing said monounsaturated triglycerides from said adsorbent and desorbing said polyunsaturated triglycerides from said adsorbent with a desorbent, the improvement comprising conducting said separation at a temperature of at least about 100° C. and said desorbent comprising p-cymene.

8. The process of claim 7 wherein said desorbent comprises about 20% (vol.) to 100% p-cymene.

* * * * *